US011641965B2

(12) United States Patent
Prince, II

(10) Patent No.: US 11,641,965 B2
(45) Date of Patent: May 9, 2023

(54) VIDEO SMART PACKAGE PILLAR

(71) Applicant: Richard Allen Prince, II, Desoto, TX (US)

(72) Inventor: Richard Allen Prince, II, Desoto, TX (US)

( * ) Notice: Subject to any disclaimer, the term of this patent is extended or adjusted under 35 U.S.C. 154(b) by 183 days.

(21) Appl. No.: 15/420,183

(22) Filed: Jan. 31, 2017

(65) Prior Publication Data

US 2021/0315403 A1 Oct. 14, 2021

Related U.S. Application Data

(60) Provisional application No. 62/290,240, filed on Feb. 2, 2016.

(51) Int. Cl.

| | |
|---|---|
| ***A47G 29/12*** | (2006.01) |
| ***A47G 29/126*** | (2006.01) |
| ***G08B 3/10*** | (2006.01) |
| ***A47G 29/122*** | (2006.01) |
| ***A47G 29/124*** | (2006.01) |

(52) U.S. Cl.

CPC ..... *A47G 29/1225* (2013.01); *A47G 29/126* (2013.01); *A47G 29/1248* (2017.08); *G08B 3/1016* (2013.01); *A47G 2029/1226* (2013.01); *A47G 2200/085* (2013.01); *A47G 2200/14* (2013.01); *A47G 2200/166* (2013.01)

(58) Field of Classification Search

CPC ..... A47G 29/16; A47G 29/20; A47G 29/30; A47G 29/126; A47G 29/141; A47G 29/1225; A47G 29/1248; A47G 2200/085; A47G 2200/14; A47G 2200/166; A47G 2029/145; A47G 2029/147; A47G 2029/148; A47G 2029/149; A47G 2029/1226; G08B 3/1016

USPC ..... 232/17, 19, 34–36, 38, 45; 340/569

See application file for complete search history.

(56) References Cited

U.S. PATENT DOCUMENTS

| | | | | |
|---|---|---|---|---|
| 4,753,386 | A * | 6/1988 | Phillion, Sr. | A47G 29/121 232/43.1 |
| 5,833,132 | A * | 11/1998 | Bachmeier | A47G 29/12095 232/47 |
| 5,898,371 | A * | 4/1999 | Marek | A47G 29/1225 340/569 |
| 6,375,071 | B1 * | 4/2002 | Kim | A47G 29/12095 232/47 |
| 6,477,514 | B1 * | 11/2002 | Gil | G06Q 30/0283 177/25.15 |
| 7,036,719 | B1 * | 5/2006 | Helphrey | A47G 29/12095 232/47 |
| 7,249,705 | B2 * | 7/2007 | Dudley | A47G 29/141 232/45 |
| 7,360,680 | B1 * | 4/2008 | Grossmeyer | A47G 29/1203 232/45 |

(Continued)

*Primary Examiner* — Joshua E Rodden

(57) ABSTRACT

Millions of packages get shipped and stolen from home door steps, with mail often getting placed in wrong mailboxes and sometimes the mailman or package carrier needs to speak to someone at or from the residence. Video Smart Package Pillar was created with all of these issues of the world in mind, combining the idea of a Pillar, compartmentalized, with two compartments, a mail compartment and package compartment, and one to two doors in a rear to obtain packages that have been delivered; while leaving an original mail pull down opening for the mail being delivered.

16 Claims, 12 Drawing Sheets

(56) References Cited

U.S. PATENT DOCUMENTS

| | | | | |
|---|---|---|---|---|
| 7,913,898 | B2 * | 3/2011 | Frankenberg | A47G 29/122 232/45 |
| 9,004,346 | B2 * | 4/2015 | Farentinos | A47G 29/22 232/43.3 |
| 9,554,646 | B1 * | 1/2017 | Charette | B01L 3/50853 |
| 10,363,560 | B1 * | 7/2019 | Charette | E05B 39/005 |
| 10,881,234 | B2 * | 1/2021 | Roberts | E05F 1/12 |
| 10,952,556 | B2 * | 3/2021 | Hara | A47G 29/20 |
| 11,103,096 | B1 * | 8/2021 | Parr | G06K 7/10297 |
| 2002/0063148 | A1 * | 5/2002 | Cox | A47G 29/16 232/47 |
| 2002/0162883 | A1 * | 11/2002 | Arvonio | G07B 17/00193 232/45 |
| 2005/0154602 | A1 * | 7/2005 | Hertz | A47G 29/1207 345/540 |
| 2008/0040243 | A1 * | 2/2008 | Chang | G06Q 10/00 705/28 |
| 2008/0067227 | A1 * | 3/2008 | Poss | A47G 29/30 232/17 |
| 2018/0008076 | A1 * | 1/2018 | Mitra | A47G 29/1225 |
| 2019/0167025 | A1 * | 6/2019 | Cherry | A47G 29/16 |
| 2019/0239673 | A1 * | 8/2019 | Silva | A47G 29/141 |
| 2019/0343317 | A1 * | 11/2019 | Cantrell | A47G 29/1248 |
| 2020/0077826 | A1 * | 3/2020 | Chenier | G07C 9/00309 |
| 2020/0113365 | A1 * | 4/2020 | Shobe | B64F 1/32 |
| 2020/0128991 | A1 * | 4/2020 | Jessie | F25D 29/00 |
| 2021/0298507 | A1 * | 9/2021 | Grijalva | A47G 29/141 |

* cited by examiner

VIDEO SMART PACKAGE PILLAR

BACKGROUND OF THE INVENTION

Millions of packages get shipped and stolen from home door steps, with mail often getting placed in wrong mailboxes and sometimes the mailman or package carrier needs to speak to someone at or from the residence. The current invention was created with these issues in mind.

BRIEF SUMMARY OF THE INVENTION

The current invention is unique by design and use for the invention creates a regulated mailbox combined with a custom package storage for storing packages separate from mail, but still connected with the same unit with security camera and special sensors and alerts to create a unique theft deterrent system for the packages and mail that's being delivered.

DETAILED DESCRIPTION OF THE INVENTION

Figure 1:
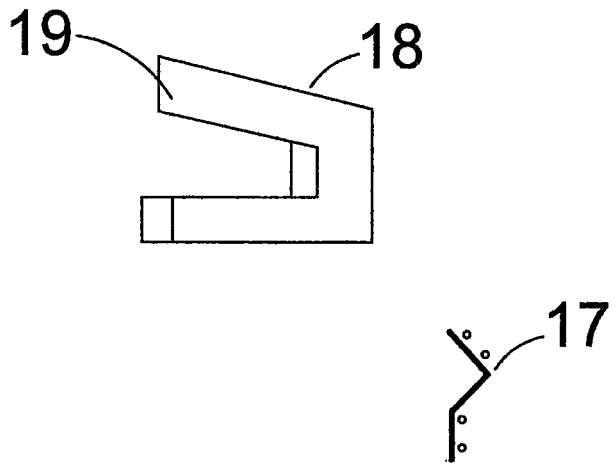
FIG. 1 is a side top view of the package pillar dealing with opening access with solar panel arrow pointing at the location of the panel and handle that will be attached to the exterior door.
Figure 2:
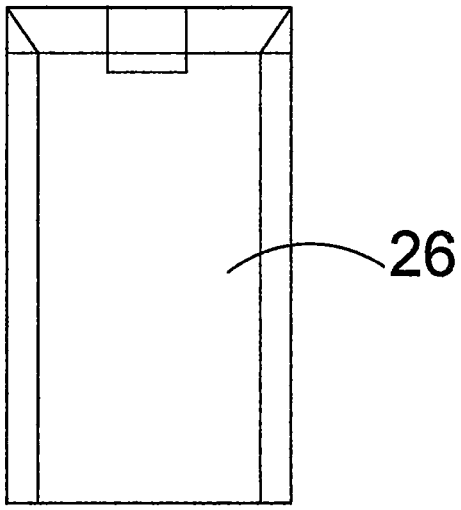
FIG. 2 is a bottom base view of the package pillar showing the shape and that its piece will connect to bottom of mail pillar and will have drain holes in corners to keep packages or whatever is placed inside dry or as dry as can be.
Figure 3:
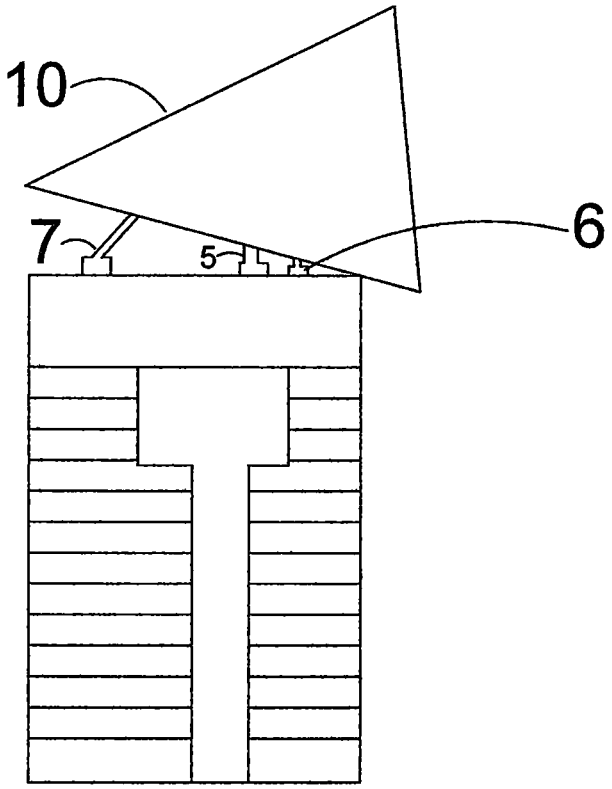
FIG. 3 is of the side view of the package pillar detailing actions of lid opening and its chambers inside.
Figure 4:
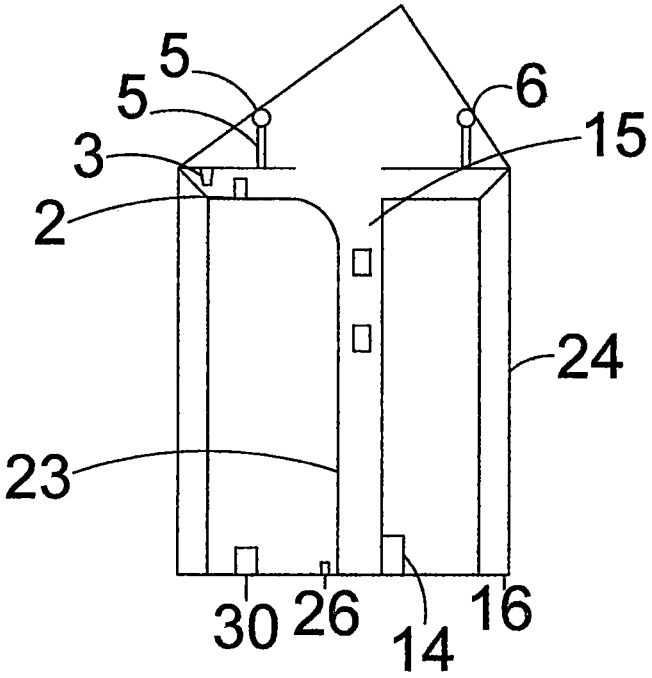
FIG. 4 is a front view of the package pillar showing internal chambers to detail inside actions and accessories.
Figure 5:
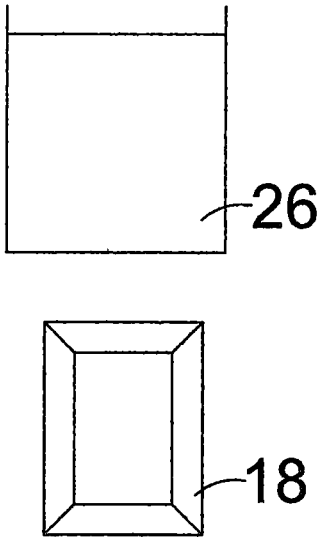
FIG. 5 is a top view of the package pillar base and solar panel, with the top view showing an angle front top view as if someone was looking down at the package pillar.
Figure 6:
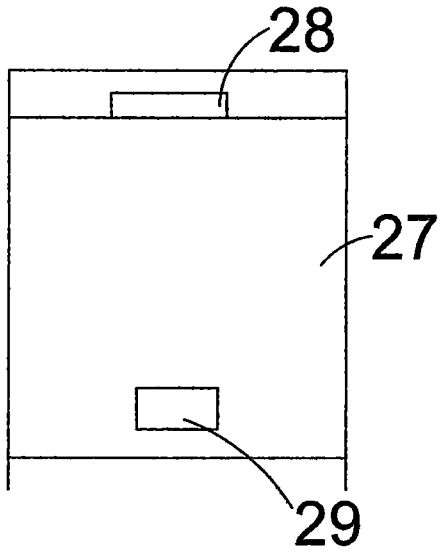
FIG. 6 is of a back view before door enlargements to show various ways the package pillar could be crafted where the bottom shows a smaller door at bottom.
Figure 7:
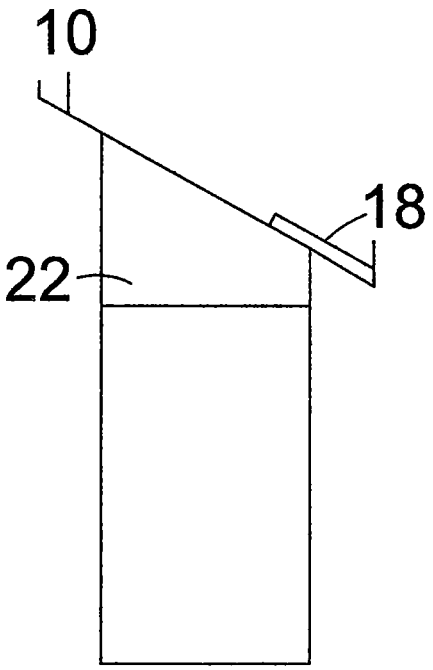
FIG. 7 shows a left sided view of the package pillar detailing the chambers.
Figure 8:
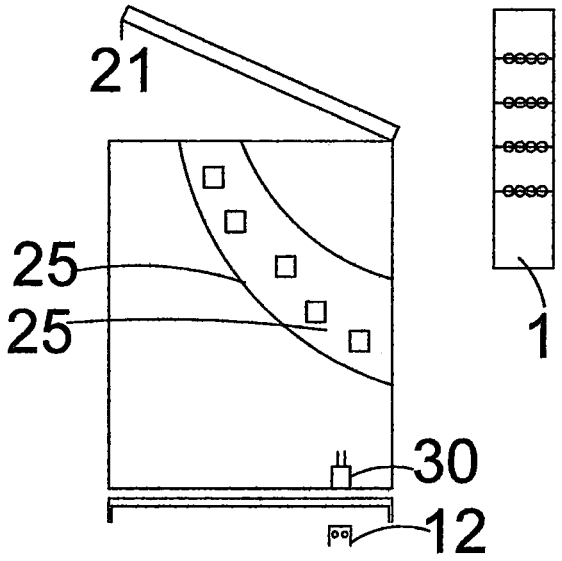
FIG. 8 shows a left side point of view detailing how the chambers work and connected parts that make it work.
Figure 9:
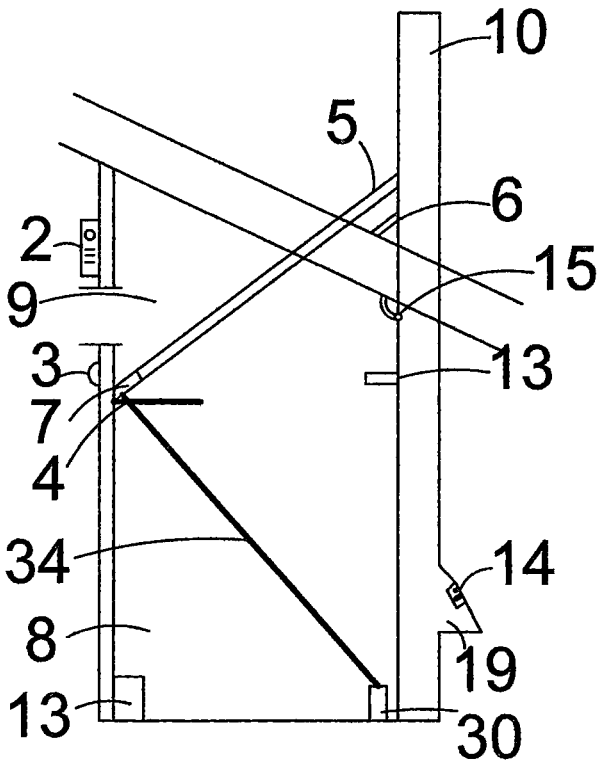
FIG. 9 is a left sided view of the package pillar detailing featured pieces as well as parts used to put the package pillar together.
Figure 10:
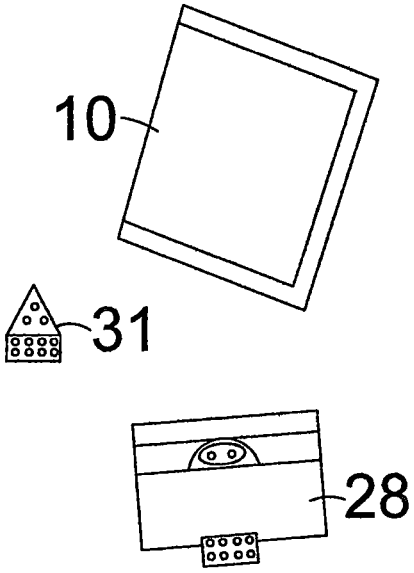
FIG. 10 is a view of key parts of the package pillar that are used for the mail pull down door.
Figure 11:
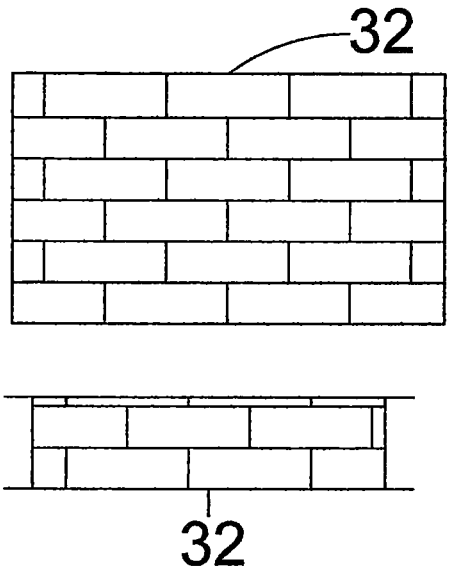
FIG. 11 is a view of an example of what exterior decor could be used to dress up the package pillar using stone, etc.
Figure 12:
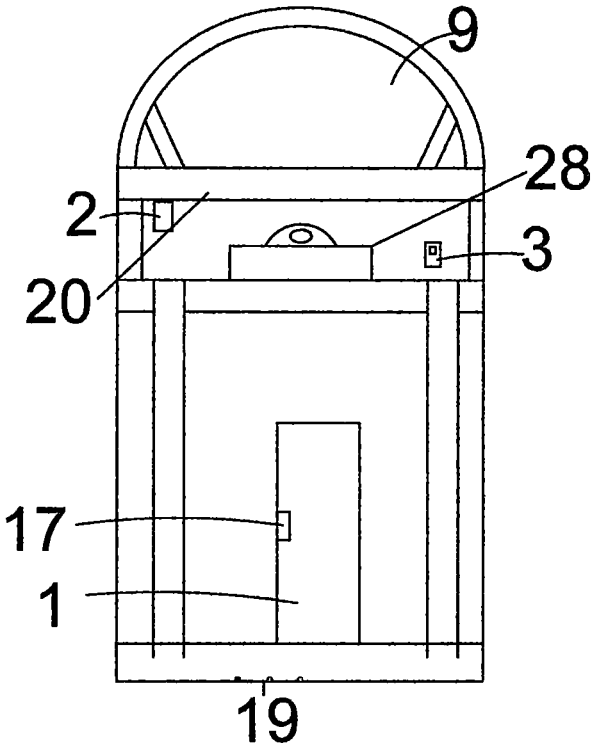
FIG. 12 is of a full front view of the package pillar with a partial see through of back door along with added features concept and shape.

The current invention, titled video smart package pillar, was created with the issues of the world in mind, combining the idea of a pillar 24, compartmentalized, with two compartments; a mail compartment 22 and package compartment 23. The pillar 24 having one to two doors, such as a back pull door 1 in a rear of the pillar 24, to obtain packages that have been delivered. The door 1 including an exterior door handle 17. The pillar 24 including a mail compartment door 28 opening for the mail being delivered. The pillar keeping both mail carriers and package handlers in a separate location for their deliveries all combined on one unit/pillar 24.

The pillar 24 including technologies such as an automated "door like" top raise door 10 that opens and closes with a button 3 and sensors 15 to auto close when packages are placed into the package storage area 23, the pillar 24 powered by a solar panel 18 and an internal battery 30 that sources to keep and maintain power.

The pillar 24 includes a camera sensor 2 with a microphone and a speaker, along with separate sensors that allow it to be turned on when motion is happening, such as night vision to be able to see people or animals when it's low light or night.

Inside the package compartment 23 there are also lights 12 to see packages in low light or night times as well as charms, alarms, and alerts to let you know if your pillar/unit 24 is being tampered with. The pillar 24 including an exterior light 20 that is solar powered for the outside of the mailbox. The pillar 24 additionally including an internal light 21 for a top of a hub shaft 8 which is a lighting system for the top of the hub shaft 8 that turns on with the system when opening.

An internal actuator 7 is used to connect the top raise door 10 and bottom base 26. An internal left pull wire 5 is a wire attached to the top raise door 10 for helping the top door raise door 10 on a left side; and an internal right pull wire 6 is a wire attached to the top raise door 10 for helping the top raise door 10 on a right side.

An internal hub shaft 8 is the area where packages will slide to the bottom base 26. An internal top shaft 9 is the area where the postal service can place regular mail.

An internal weight handler 11 is used to make sure packages lower themselves to the bottom base 26 of the hub shaft 8 without breaking, giving them a softer landing. The internal weight handler 11 handles weight variations. An internal temperature regulator 13 that regulates temperature; keeping the internal portions of the pillar/unit 24 at a suitable temperature for packages and mail.

An internal door sensor 14 was developed to give notifications on devices of various actions that may be happening within the pillar 24 or to the various doors of the pillar 24. An internal sensor door lock latch 15 for the top raise door 10. This lock latch 15 is to show various actions and make various actions like locking, opening, sending notifications of its state. An exterior sensor door lock 16 for hub shaft 8. This lock is a lock and sensor for opening hub shaft 8, the exterior sensor door lock 16 having sensors have various capabilities like sending temperature readings, smart open and lock and chime alarm.

Internal liquid drain holes 19 inserted for drainage if moisture gets inside the hub shaft 8, the holes 19 placed in the hub shaft 8.

A bottom base 26 is a formulated base platform to hold the hub shaft 8 in place against weather and weight. A front of the pillar 27 is the front facing viewpoint of the pillar/unit 24 of where the camera, lighting and entrance of the mail and package functions are located.

The mail compartment door 28 is the door that opens and shut for postal carriers to load mail. An access to belt down 29 is a compartment accessible to a belt that raises and shut the top raise door 10. Front door hinges 31 are the hinges that latch to the mail compartment door 28.

Exterior stone 32 is one form of decoration that comes part of an outer layer of the hub shaft 8. Internal wiring 33 is a wiring system that connects to the described power source and the other elements of the pillar 24 to make the various aspects of the pillar 24 function.

The pillar/unit 24 is to be set at normal and regulated mailbox areas as well as close to doors on property.

An apartment design of the pillar/unit 24 has a metal latch grip that mounts to a top of an apartment or condo door. It's sizes custom but has four sides a top and a bottom. Where the top is an automated "door like" hatch that opens with a button. The apartment version comes only for small or normal sized packages, its body drops just below the peep hole, to keep from blocking the residences view. The model comes with same video camera that has microphone and speaker so the resident can be anywhere and still be able to see someone delivering packages or trying to steal them. These units are theft deterrent.

Listing of Reference Numerals

1 Back Pull Door;
2 Video Camera Sensor;
3 Lever Button;
4 Internal Pull Pad;
5 Internal Left Pull Wire;
6 Internal Right Pull Wire;
7 Internal Actuator;
8 Internal Hub Shaft;
9 Internal Top Shaft;
10 Top Raise Door;
11 Internal Weight Handler;
12 Internal Sensor Light;
13 Internal Temperature Regulator;
14 Internal Door Sensor;
15 Internal Sensor Door Lock Latch for Top Raise Door;
16 Exterior Sensor Door Lock for Door Hub;
17 Exterior Door Handle;
18 Solar Panel;
19 Internal Liquid Drain Holes;
20 Exterior Light;
21 Internal Light;
22 Mail Compartment;
23 Package Compartment;
24 Whole Pillar/One Unit;
25 Interior Package Slope;
26 Bottom Base;
27 Front of Pillar;
28 Mail Compartment Door;
29 Access to Belt Down;
30 Internal Battery;
31 Front Door Hinges;
32 Exterior Stone;
33 Internal Wiring.

We claim:

1. A theft deterrent mailbox pillar comprising:

a top mail compartment and a bottom package compartment located below the mail compartment and separated by an internal moving dividing flap;

a video camera sensor for recording audio and video, and a separate photo taking camera connected to the mailbox pillar;

an electronic button connected to a top raise door which includes an internal actuator and a plurality of pull wires on part of the top raise door, the top raise door allowing access to a top of the mail compartment;

a back pull door on a back of the pillar that allows access to the package compartment, the back pull door including an exterior sensor door lock including smart lock and latch electronic locking to allow for package retrieval;

a mail compartment door on a front of the pillar allowing to be opened to receive mail being delivered into the top mail compartment;

a plurality of sensor lights, a plurality of alert sensors, an internal temperature regulator, and alarms connected to said top raise door and said back pull door; and technology for mobile connection and receiving weather alerts.

2. The mailbox pillar according to claim 1, further comprising: the package compartment is larger than said mail compartment.

3. The mailbox pillar according to claim 1, the video camera sensor providing two-way audio.

4. The mailbox pillar according to claim 1, further comprising the top raise door connected to said actuators and said pull wires to raise and close to receive packages.

5. The mailbox pillar according to claim 1, further comprising respective ones of the alert sensors connected to said back pull doors and said mail compartments door inside said pillar.

6. The mailbox pillar according to claim 1, further comprising respective ones of the sensor lights located inside the package compartment, and inside the mail compartment.

7. The mailbox pillar according to claim 1, further comprising the top raise door, the back pull door and the mail compartment door configured to allow the pillar to accept and receive the mail.

8. The mailbox pillar wherein according to claim 1, configured to provide function of alerts and alarms that send noise or recording and mobile alerts when detecting tampering with the pillar.

9. The mailbox pillar according to claim 1, further comprising: the smart lock and latch electronic locking relates to providing access to a hub shaft in the package compartment.

10. The mailbox pillar according to claim 1, further comprising: a solar panel on the top raise door.

11. The mailbox pillar according to claim 10, further comprising: said solar panel in combination with a battery to power said pillar.

12. The mailbox pillar according to claim 1, further comprising said sensor lights connected to an inside hub shaft inside the mail compartment for visibility in low or no light times.

13. The mailbox pillar according to claim 1, further comprising the internal temperature regulator connected to layered cooling and heating parts along with drain holes to keep mail and packages from overheating or sustaining moisture to keep mail and packages safe and dry.

14. The mailbox pillar according to claim 1, further comprising said pillar configured for homes or buildings.

15. The mailbox pillar according to claim 1, further comprising: said pillar configured for apartments and small occupancy spaces.

16. The mailbox pillar according to claim 1, configured to create a theft deterrent product that postal and shipping handlers within regulations can both deliver to a shared space that would minimize theft and create more privacy yet more visible and accessible to both shipper and receiver.

* * * * *